United States Patent [19]

Ohse et al.

[11] 3,995,420

[45] Dec. 7, 1976

[54] HIGHLY ELASTIC SYNTHETIC CRIMP YARN WITH LOW RESIDUAL LATENT CRIMP AND PROCESS FOR PRODUCING SAID YARN

[75] Inventors: Helmut Ohse, Zons; Wolfgang Müller, Dormagen-Hackenbroich; Walter Hofmann, Dormagen; Jürgen Walther, Dormagen-Dellhoven, all of Germany

[73] Assignee: Bayer Aktiengesellschaft, Leverkusen, Germany

[22] Filed: Oct. 15, 1974

[21] Appl. No.: 514,998

[30] Foreign Application Priority Data

Oct. 19, 1973 Germany ..... 2352517

[52] U.S. Cl. ..... 57/140 R; 57/157 TS

[51] Int. Cl.[2] ..... D02G 3/26; D02G 1/02; D02G 3/32

[58] Field of Search ..... 57/34 R, 34 HS, 157 TS, 57/140 R

[56] References Cited

UNITED STATES PATENTS

| | | | |
|---|---|---|---|
| 3,041,813 | 7/1962 | Enneking | 57/34 HS |
| 3,041,814 | 7/1962 | Held | 57/34 HS |
| 3,310,857 | 3/1967 | Loftin et al. | 57/157 TS |
| 3,318,083 | 5/1967 | Gilchrist | 57/34 HS X;157 TS |
| 3,472,011 | 10/1969 | Scragg | 57/34 HS |

*Primary Examiner*—Donald E. Watkins
*Attorney, Agent, or Firm*—Plumley and Tyner

[57] ABSTRACT

The invention relates to a process for the production of a false-twist textured, highly elastic, synthetic crimp yarn with low residual shrinkage and latently bound crimp by stretching, false-twisting, heat-fixing and thermal after-treatment of the synthetic yarn at yarn draw-off rates of from 400 to 900 m/min, in which the thread tension during thermal after-treatment is 6–25% of the thread tension during heat-fixing, the time of thermal after-treatment is 2–5% of the time spent in heat-fixing and the temperature of the yarn during the thermal after-treatment is 30°–100° C.

8 Claims, 2 Drawing Figures

Figure 1:
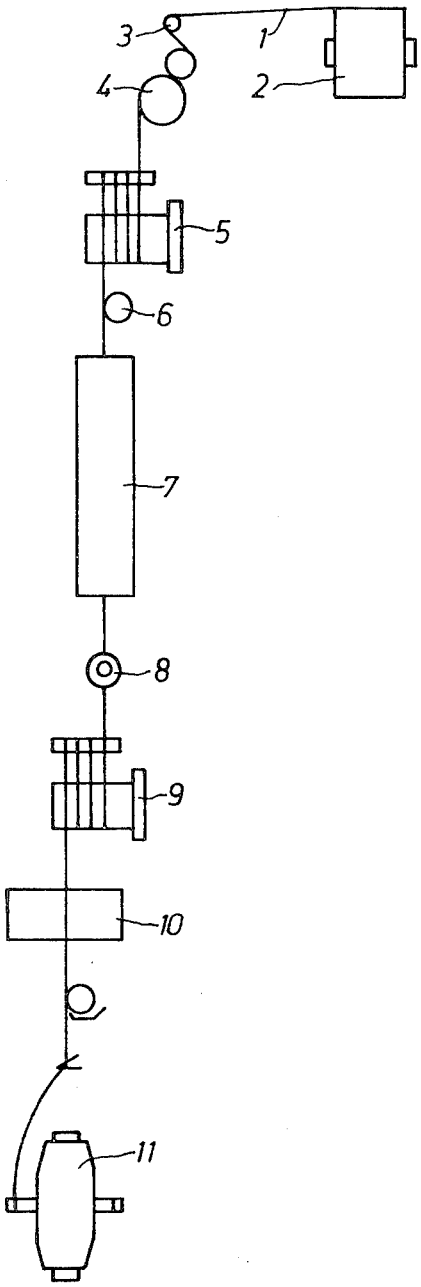

HIGHLY ELASTIC SYNTHETIC CRIMP YARN WITH LOW RESIDUAL LATENT CRIMP AND PROCESS FOR PRODUCING SAID YARN

This invention relates to a process for producing a false twist textured yarn with low residual shrinkage and latent, bound crip by thermal after-treatment of the yarn is an almost tension-free state.

Processes and apparatus are known for after-treating highly elastic crimp yarns by heating. These compensate for internal tensions due to the texturing process by twisting the yarn in the opposite direction in a following heating apparatus. There are also specially constructed machines available for heat-stabilising or - setting crimp yarn to the required extent, but they are very expensive.

Other machines are known which stretch a yarn as it comes off the spinning spool, texture it and then stabilise it by heat, all in one continuous process.

These processes and apparatus have the disadvantage that the thermal after-treatment considerably reduces the total crimp and the stability of the crimp with the result that the highly elastic properties of the yarn are lost. When the yarn is made up into knitted goods, for example, into stockings in particular, this manifests itself in insufficient stretchability of the knitted product.

It is an object of this invention to obviate the disadvantages of the known processes and to provide an apparatus with a highly elastic crimp yarn with low residual shrinkage values can be produced without the crimp and stability of the crimp, and hence the high elasticity of the yarn, being destroyed by the thermal after-treatment.

According to the invention, this object is achieved by stretching a synthetic, thermoplastic yarn over a thread guide device between a delivery roller and a draw-off roller, twisting it to a high twist with a false twisting device preceded by a fixing and heating device, and fixing it (successive process). If desired, false twisting may also be carried out within the stretching zone by the so-called simulataneous process. The yarn is then passed in an almost tension-free state over a second heating rail for thermal after-treatment (setting process) and twisted on to a spindle. The twisting apparatus is equipped with an adjustable drive to maintain a constant low thread tension in the after-treatment zone.

The yarn stays in the thermal after-treatment zone for only a very short time which is from 2 to 5%, preferably 3%, of the fixing time. This time of stay can be determined as required by adopting suitable dimensions of the fixing zone and after-treatment zone. The two heating zones are arranged in parallel for the sake of simplicity and are therefore at the same temperature, which may be in the range of from 140° to 210° C, preferably from 160° to 180° C. The very short time of stay in the after-treatment zone prevents the yarn from assuming the surface temperature of the heating rail. This is necessary because otherwise the physical binding system which stabilises the form of the crimp would be dissolved. The resulting comparatively low yarn temperature, which is in the region of from 30° to 100° C and preferably from 50° to 70° C, reduces the boiling shrinkage by about 3% to a residual shrinkage of 6 to 7% and enables the crimp to be latently bound at a suitable tension. The yarn tension in the setting zone is somewhere between the crimp contraction power and the shrinkage power so that a material shrinkage of about 3% may occur but crimp contraction does not occur. Under these mechanical and thermal conditions of after-treatment, the crimp which forms spontaneously is temporarily pulled out but fully redeveloped when the yarn is subsequently processed. An exceptionally high proportion of latently bound crimp is thereby obtained. This causes the crimp contraction force in the developed yarn to increase to about twice that found in conventional high-elasticity yarn.

This invention therefore provides a process for the production of a false twist textured, highly elastic synthetic crimp yarn with a low residual shrinkage and latently bound crimp which comprises stretching, false twisting, heat fixing and thermal after-treatment of a synthetic yarn at yarn draw-off rates of from 400 to 900 m/min, wherein the yarn tension during the thermal after-treatment is 6–25%, preferably 20–22%, of the yarn tension during the transparency fixing operation, the yarn temperature assumes values of from 30° elasticity 100° C, preferably 50°–70° C, and the duration of thermal after-treatment is 2 – 5%. preferably 3%, of the time spent in heat fixing.

The yarn obtained by the process according to the invention is distinguished from known thermo-stabilised elastic yarns by the fact that the boiling shrinkage is reduced by the thermal after-treatment but the high crimp and good stability of crimp are preserved. Yarn treated in this way shows a slightly higher stretchability in the crimp region at every processing stage than yarn which has not been after-treated. The very fine arc of the crimp imparts a fine stitch with high transparence to the finished article, in contrast to the mossy appearance of known high elaasticity yarns. Knitted goods produced from this yarn are therefore less liable to damage and are very hard wearing. In addition, the very high degree of latently bound crimp ensures that the thread runs smoothly off the spool, reduces the frequency of reversal of the cop and provides favourable conditions for processing of the yarn in knitting machines.

Another advantage is the greater dye absorption of the yarn. This is caused by the disorientation of intercrystalline molecular segments which occurs during thermal after-treatment (material shrinkage). The low residual shrinkage of the yarn moreover reduces the amount of material required in subsequent processes.

The invention also provides a thermo-stabilized, highly elastic, textured endless yarn which has a residual shrinkage of 6 to 7 %, a latent crimp of at least 80 %, a crimp stretchability of at least 230 %, a crimp stability of at least 60 % and a crimp contraction force of from 8 to 10 10 mp/dtex.

The mechanical crimp stability is determined according to DIN proposal 53 840, whereby this characteristic is expressed in terms of the ratio of the crimp after application of a heavy load to the normal crimp.

The invention also relates to an apparatus for carrying out the process as defined above. It is an essential feature of the apparatus that the heating means used for fixing and the heating means used for setting are connected in parallel in a single heating system and that their lengths are related to each other in a ratio of from 20 : 1 to 50 : 1, preferably 30 : 1. The length of the heat fixing device is 1–4 m, preferably 2–3 m.

The invention further provides an apparatus for carrying out the process according to claim 1, comprising a delivery roller 4, a stretching roller 5, a heating means 7 for fixing, a friction twisting device 8, a heating means 10 for setting and a twisting spindle 11, wherein the heating means for fixing and the heating means for setting are connected in parallel in a single heating system and their lengths are related to each other in a ratio of from 20 : 1 to 50 : 1.

The apparatus is described below with reference to the schematic drawings.

Figure 2:
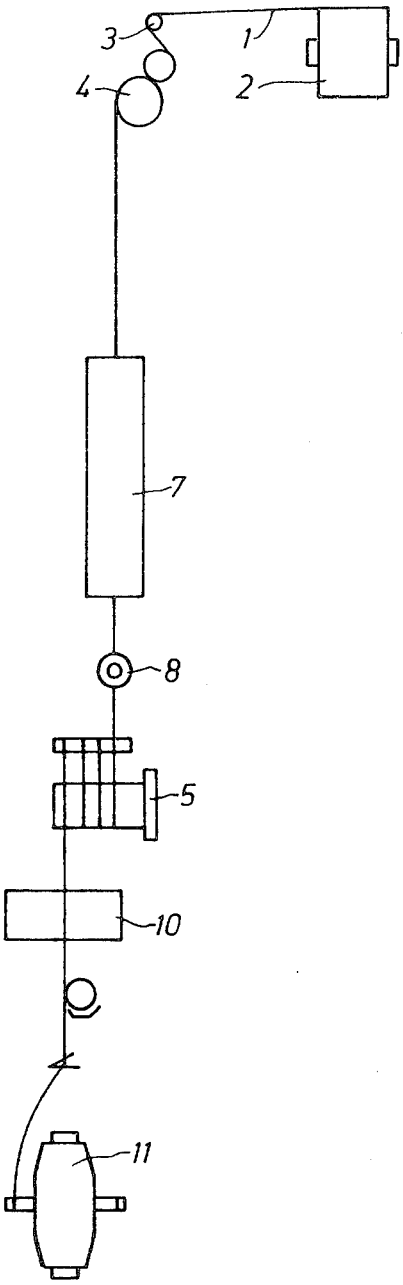

FIG. 1 shows an apparatus for carrying out the process by successive stretch texturing and FIG. 2 shows an apparatus for carrying out the process by simultaneous stretch texturing.

A yarn 1 runs off a spinning spool 2 over thread guides 3 into a delivery mechanism 4. The yarn is stretched between the delivery mechanism and a stretching roller 5 and is then introduced into a heat-fixing device 7 via a twist blocking device 6 which prevents the yarn from slipping off the stretching roller. The heating device may be a radiant heating element or preferably a contact heating rail which enables intensive heat transfer to be achieved between the heating surface and the yarn. The twists imposed on the yarn by a following internal friction twister 8 are fixed in the heating zone. The yarn tension in the texturing zone is maintained by a draw-off roller 9 situated betwen the texturing zone and the stretching roller 5. The yarn then runs almost free of tension over a setting heating rail 10 for thermal after-treatment and is then wound on to a doubling cop 11.

The apparatus of FIG. 2 represents a substantial simplification of the process in that stretching and texturing are combined in one device.

In this case the yarn 1 from the delivery mechanism 4 is first passed over a heating device 7 to an internal friction twister 8 where it is twisted, and the twists are fixed in the heating device 7. At the same time, the yarn is stretched to the full stretching ratio in this zone between the delivery mechanism 4 and the stretching roller 5. As the stretching process and the texturing process are combined in one device, it is possible to dispense with the twist blocking devices 6 and draw-off roller 9 and thereby to simlify considerably the construction of the machine. After passing through this zone, the yarn passes over a heating and setting device 10 for thermal after-treatment and is wound on to the cop 11 in the same way as in FIG. 1.

In both apparatus, the thread advantageously runs in one direction through the machine without being deflected or reversed. The heating rails may be heated electrically, or preferably with steam or liquid. An advantage of heating with steam or liquid is that the heat-fixing rails and heat-setting rails can be directly coupled together so that both heating devices are at the same temperature and hence a single control device is sufficient to ensure a constant temperature. To keep the temperature of liquid heating means constant in a widely branched system, the heat transfer fluid is circulated through the pipes at a high velocity by means of a pump. The cross-section of the heating element is preferably so designed that turbulence is produced in the heating medium at suitable velocity so as to ensure optimum heat transfer. The heating rails for the thermal after-treatment are preferably contact elements. To ensure reliable guiding of the thread over the surface, the front end of the heating element is slightly curved outwards and the upper and lower edges are rounded off. The contact heating rails can be adjusted to a surface roughness of $R_t = 8$ to 40 $\mu$m by coating, sand-blasting or pickling. The advantage of this is that efficient heat transfer to the thread is combined with considerably reduced frictional resistance.

Yarns of polyamides are suitable for carrying out the process, preferably yarns of polycaprolactam and polyesters.

The yarn according to the invention and its manufacture are illustrated by the following Examples by which the invention is not intended to be limited.

EXAMPLE 1

A polyamide-6 filament of 22 f 3 dtex (multifil raw titre 68.2 dtex) is prestretched in the cold in a ratio of 1 : 3.1 between the delivery mechanism 4 and stretching roller 5 at a rate of filament movement of 500 m/min. In the following texturing zone, it is passed over a contact heating rail 7 which is at a surface temperature of 170° C and is then textured in the friction twister 8 at 18000 revs. per min. The length of the heater is 2500 mm. After passing over the stretching roller, the filament runs over the second heating rail 10 which has a length of 80 mm and the temperature of which is also adjusted to 170° C. The time of thermal after-treatment is 3.2 % of the time spent in heat-fixing and the temperature of the yarn during the thermal after-treatment is 70° C. It is then wound and made up into a cop 11 at the same tension. The final titre is 22 dtex.

Yarn treated in this way has a latent crimp of 81 %, a residual shrinkage of 6 %, a crimp contraction force of 9.7 mp/dtex and a crimp stability of 6 %.

EXAMPLE 2

A polyamide-6 filament of 22 f5 dtex (multifil raw titre 72 6 dtex) is stretched in a ratio of 1 : 3.30 between the delivery mechanism 4 and roller 5. The filament velocity after the roller 5 is 500 m/min. At the same time, the filament is twisted in a friction twister 8 in the stretching zone, and the twists imparted to it are fixed in a preceding contact heating rail 7 which is 2500 mm in length. The speed of rotation of the twister is 18 000 revs per min. The surface of the fixing heater is at a temperature of 170° C. The now textured yarn is then passed over the second heating rail 10 which has a length of 80 mm and is then spooled and doubled on to a cop 11. The temperature of the second heating rail is also 170° C.

The material produced in this way has a latent crimp of 84%, a residual shrinkage of 5.5%, a crimp contraction force of 8.7 mp/dtex and a crimp resistance of 62%.

Stockings produced from this yarn under specified knitting conditions have an elastic stretchability of 101% in the longitudinal direction and 143% in the transverse direction.

It goes without saying that the invention is not restricted to the embodiment described and represented here but that it is capable of modifications within the framework of the subject of the invention and within the scope of the appended claims.

We claim:

1. A process for the production of a false twist textured, highly elastic, synthetic crimp yarn with low residual shrinkage and latently bound crimp by stretching, false twisting, heat-fixing and thermal after-treatment of the synthetic yarn at yarn drawn-off rats of from 400 to 900 m/min, in which the thread tension during thermal after-treatment is 6–25% of the thread tension during heat-fixing, the time of thermal after-treatment is 2–5% of the time spent in heat-fixing and the temperature of the yarn during the thermal after-treatment is 30°–100° C.

2. A process according to claim 1, in which the thread tension during thermal after-treatment is 20–22% of the thread tension during heat-fixing.

3. A process according to claim 1, in which the temperature of the yarn during thermal after-treatment is 50°–70° C.

4. A process according to claim 1, in which the thermal after-treatment time is 3% of the time spent in heat-fixing.

5. A process according to claim 1, in which the yarn is simultaneously stretched and textured in one zone (simultaneous process).

6. A process according to claim 1, in which the yarn is first stretched in one zone and then textured in another zone (successive process).

7. A process according to claim 1, in which the heating means used for fixing and the heating means used for after-treatment are both at the same temperature, which may assume values of from 140° to 220° C.

8. Highly elastic crimp yarn of synthetic endless filaments, having a residual shrinkage of 6 to 7%, a latent crimp of at least 80%, a crimp stretchability of at least 230%, a crimp stability of at least 60% and a crimp contraction force of 8 to 10 mp/dtex.

* * * * *